US010604374B2

(12) United States Patent
Morand

(10) Patent No.: US 10,604,374 B2
(45) Date of Patent: Mar. 31, 2020

(54) ROLLED PRODUCT DISPENSER WITH MULTIPLE CUTTING BLADES AND CUTTER ASSEMBLY FOR A ROLLED PRODUCT DISPENSER

(71) Applicant: CASCADES CANADA ULC, Montreal (CA)

(72) Inventor: Michel Morand, Verdun (CA)

(73) Assignee: CASCADES CANADA ULC, Montreal, Quebec (CA)

( * ) Notice: Subject to any disclaimer, the term of this patent is extended or adjusted under 35 U.S.C. 154(b) by 74 days.

(21) Appl. No.: 15/845,188

(22) Filed: Dec. 18, 2017

(65) Prior Publication Data

US 2018/0162677 A1 Jun. 14, 2018

Related U.S. Application Data

(63) Continuation of application No. 14/119,633, filed as application No. PCT/CA2012/050674 on Sep. 26, 2012, now Pat. No. 9,878,869.
(Continued)

(51) Int. Cl.
*B65H 35/00* (2006.01)
*A47K 10/36* (2006.01)

(52) U.S. Cl.
CPC ..... *B65H 35/0086* (2013.01); *A47K 10/36* (2013.01); *A47K 2010/365* (2013.01); *Y10T 83/323* (2015.04); *Y10T 83/896* (2015.04)

(58) Field of Classification Search
CPC ..... B65H 35/0086; A47K 10/3631; A47K 10/36; Y10T 83/896; Y10T 83/323
(Continued)

(56) References Cited

U.S. PATENT DOCUMENTS 1,553,331 A * 9/1925 Shelley ..... A47K 10/22 83/334
3,826,548 A 7/1974 Schnyder et al.
(Continued)

FOREIGN PATENT DOCUMENTS

CA 2363744 C 1/2010
CN 2451022 Y 10/2001
(Continued)

OTHER PUBLICATIONS

American Specialties Inc., Recessed Mounted Automatic Roll Paper Towel Dispenser, Model No. 045210A.
Bradley, Model 2494—Surface Mounted with Sensor Activation BradEx®, 2010, Bradley Corporation.
(Continued)

*Primary Examiner* — Ghassem Alie
*Assistant Examiner* — Bharat C Patel
(74) *Attorney, Agent, or Firm* — Eversheds Sutherland (US) LLP

(57) ABSTRACT

There is provided a rolled product dispenser for dispensing a web of rolled product. The rolled product dispenser includes a housing, a dispensing assembly operationally connected to the housing and interacting with the web of the rolled product and a cutting assembly cooperating with the dispensing assembly to sever the web of rolled product. The cutting assembly includes at least two cutting blades, each one of the cutting blades having a first end and a second end. The first end is pivotally mounted and the second end is operationally connected to a guiding assembly for guiding the blade between a cutting position and a non-cutting position.

25 Claims, 8 Drawing Sheets

Related U.S. Application Data

(60) Provisional application No. 61/539,028, filed on Sep. 26, 2011.

(58) Field of Classification Search
USPC ..... 83/321–322, 335–337, 949, 361, 83/648–650, 303, 295; 225/10, 15, 23, 225/30, 47, 96, 106
See application file for complete search history.

(56) References Cited

U.S. PATENT DOCUMENTS

RE28,911 E 7/1976 Jespersen et al.
4,052,248 A * 10/1977 Hunter ..... B65H 35/004 156/511
D246,744 S 12/1977 Cassia
4,137,805 A 2/1979 Deluca et al.
4,186,633 A * 2/1980 Baumann ..... A47K 10/3643 83/155
D255,733 S 7/1980 Benjamin
D257,302 S 10/1980 Benjamin
4,307,638 A * 12/1981 DeLuca ..... A47K 10/3687 226/91
4,307,639 A 12/1981 Deluca et al.
D263,181 S 3/1982 Thompson
D266,039 S 9/1982 Deluca
4,367,666 A 1/1983 Toth
4,404,880 A 9/1983 Deluca
4,426,245 A * 1/1984 Driscoll ..... B65H 35/004 156/511
4,572,761 A * 2/1986 Phillips, Sr. ..... B65H 35/04 156/511
D283,573 S 4/1986 Bernard
D283,574 S 4/1986 Bernard
D283,575 S 4/1986 Bernard
D284,247 S 6/1986 Fine
D286,235 S 10/1986 Collins
D286,236 S 10/1986 Collins
4,624,031 A 11/1986 Simard
4,635,837 A * 1/1987 Granger ..... A47K 10/3687 225/106
D288,161 S 2/1987 Payne, Jr. et al.
4,666,099 A 5/1987 Hoffman et al.
D292,546 S 11/1987 Tegner
D293,750 S 1/1988 Leotta
4,721,265 A 1/1988 Hawkins
4,790,490 A 12/1988 Chakravorty
4,796,825 A 1/1989 Hawkins
4,826,262 A 5/1989 Hartman et al.
4,846,035 A * 7/1989 Granger ..... A47K 10/3643 83/337
D306,384 S 3/1990 Morand
4,919,351 A 4/1990 McNeil
D310,758 S 9/1990 Breger
D310,759 S 9/1990 Breger
D310,923 S 10/1990 Breger
4,960,248 A 10/1990 Bauer et al.
D312,179 S 11/1990 De Luca et al.
D312,180 S 11/1990 Perrin et al.
D312,369 S 11/1990 De Luca et al.
5,001,953 A 3/1991 Pfeiffer
D316,200 S 4/1991 Dawson
D316,788 S 5/1991 Fischer et al.
5,031,257 A 7/1991 Jeffery
5,031,258 A 7/1991 Shaw
D321,803 S 11/1991 Dawson
5,108,357 A 4/1992 Granger
5,135,147 A 8/1992 Granger
5,146,830 A * 9/1992 Granger ..... A47K 10/3643 83/337
D332,023 S 12/1992 Campbell
D332,194 S 1/1993 Hines
D335,412 S 5/1993 Howard et al.
D339,705 S 9/1993 Howard et al.
D341,970 S 12/1993 Brandenburg
D346,519 S 5/1994 Krueger et al.
D347,534 S 6/1994 Gottselig
D347,535 S 6/1994 Krueger et al.
D356,707 S 3/1995 Morand
5,429,025 A 7/1995 Bartsch et al.
5,452,832 A 9/1995 Niada
D363,628 S 10/1995 McCanless
D365,713 S 1/1996 Chen
D373,277 S 9/1996 Giugiaro
5,573,318 A 11/1996 Arabian et al.
D382,157 S 8/1997 Jeffrey
D386,922 S 12/1997 Sedlock
D389,684 S 1/1998 Dixon, Jr.
D391,104 S 2/1998 Tramontina
D398,797 S 9/1998 Brandenburg et al.
D399,084 S 10/1998 Tramontina
D403,905 S 1/1999 Tramontina
D405,303 S 2/1999 Giugiaro
D406,974 S 3/1999 King et al.
D408,184 S 4/1999 Tramontina
D416,725 S 11/1999 Lewis
D417,109 S 11/1999 Johnson et al.
D421,542 S 3/2000 Tramontina
D422,437 S 4/2000 Conran et al.
D423,263 S 4/2000 King et al.
6,069,354 A 5/2000 Alfano et al.
6,098,917 A 8/2000 Cruz
6,105,898 A 8/2000 Byrd et al.
D441,229 S 5/2001 Andersson
6,279,777 B1 8/2001 Goodin et al.
D447,372 S 9/2001 Fisscher
D447,373 S 9/2001 Fisscher
D447,657 S 9/2001 Fisscher
D447,658 S 9/2001 Fisscher
D447,897 S 9/2001 Fisscher
D447,898 S 9/2001 Fisscher
D448,222 S 9/2001 Fisscher
D448,223 S 9/2001 Fisscher
D450,500 S 11/2001 Andersson
D450,501 S 11/2001 Phelps et al.
D450,963 S 11/2001 Phelps et al.
6,314,850 B1 * 11/2001 Morand ..... A47K 10/3643 83/322
D451,323 S 12/2001 Phelps et al.
D451,728 S 12/2001 Phelps et al.
D452,095 S 12/2001 Phelps et al.
D452,096 S 12/2001 Phelps et al.
6,363,825 B1 4/2002 Hagleitner
6,408,727 B1 6/2002 Harris et al.
6,450,076 B1 9/2002 Granger
6,553,879 B2 4/2003 Morand
6,578,790 B1 6/2003 Campagna
6,581,500 B1 6/2003 Kietaibl
6,591,727 B1 7/2003 Purcell et al.
6,609,449 B2 8/2003 Granger
D482,221 S 11/2003 Phelps et al.
6,644,155 B2 11/2003 Phelps et al.
6,668,693 B2 12/2003 Niada
6,684,751 B2 2/2004 Kapiloff et al.
D488,654 S 4/2004 Omdoll et al.
D488,655 S 4/2004 Tramontina et al.
6,736,348 B1 5/2004 Formon et al.
6,745,925 B2 6/2004 Brzyski
6,749,148 B2 6/2004 Helfer-Grand
6,851,642 B2 2/2005 Wilson et al.
6,860,447 B2 3/2005 Boone et al.
D504,041 S 4/2005 Dudley et al.
6,883,787 B2 4/2005 Allen
6,956,498 B1 10/2005 Gauthier et al.
6,962,101 B2 11/2005 Granger
6,977,588 B2 12/2005 Schotz et al.
6,988,689 B2 1/2006 Thomas et al.
6,994,408 B1 2/2006 Bunnell
7,022,188 B2 * 4/2006 Ganci ..... B05B 12/24 118/504
D522,781 S 6/2006 Wieser et al.
D522,784 S 6/2006 Omdoll et al.
D525,063 S 7/2006 Woods et al.
D525,465 S 7/2006 Omdoll et al.

(56) References Cited

U.S. PATENT DOCUMENTS

| | | | | |
|---|---|---|---|---|
| 7,111,805 | B2 | 9/2006 | Notarnicola | |
| 7,168,602 | B2 | 1/2007 | Broehl | |
| 7,191,977 | B2 | 3/2007 | Denen et al. | |
| D542,497 | S | 5/2007 | Orgna et al. | |
| 7,234,381 | B2 | 6/2007 | Granger | |
| 7,275,655 | B2 | 10/2007 | Duff | |
| 7,287,720 | B1 | 10/2007 | Allegre et al. | |
| 7,296,765 | B2 | 11/2007 | Rodrian | |
| 7,304,569 | B2 | 12/2007 | Marcichow | |
| D559,597 | S | 1/2008 | Corral | |
| D560,939 | S | 2/2008 | Valot | |
| D567,556 | S | 4/2008 | Orgna et al. | |
| 7,357,348 | B2 | 4/2008 | Kananen | |
| D568,665 | S | 5/2008 | Friesen et al. | |
| D569,667 | S | 5/2008 | Ovelar | |
| 7,370,824 | B1 | 5/2008 | Osborne | |
| D571,134 | S | 6/2008 | Collado | |
| D571,135 | S | 6/2008 | Collado | |
| 7,380,748 | B2 | 6/2008 | Goeking et al. | |
| 7,416,152 | B2 | 8/2008 | Wieser et al. | |
| 7,441,681 | B2 | 10/2008 | Butsch et al. | |
| D583,174 | S | 12/2008 | Kuehneman et al. | |
| 7,500,420 | B2 | 3/2009 | Cvjetkovic et al. | |
| 7,523,885 | B2 | 4/2009 | Lewis | |
| 7,527,215 | B1 | 5/2009 | Siddiqui | |
| 7,554,084 | B2 | 6/2009 | Mok et al. | |
| D595,523 | S | 7/2009 | Pattberg | |
| 7,571,670 | B2 * | 8/2009 | Formon | A47K 10/3643 225/96 |
| D613,536 | S | 4/2010 | Pattberg | |
| 7,698,980 | B2 | 4/2010 | Morris et al. | |
| D618,479 | S | 6/2010 | Pinney | |
| 7,726,599 | B2 | 6/2010 | Lewis et al. | |
| D619,835 | S | 7/2010 | Goeking et al. | |
| D619,836 | S | 7/2010 | Kim | |
| D619,837 | S | 7/2010 | Kim | |
| D619,838 | S | 7/2010 | Kim | |
| 7,748,585 | B2 | 7/2010 | Shek | |
| D620,733 | S | 8/2010 | Denis et al. | |
| D623,452 | S | 9/2010 | McNeely et al. | |
| D624,340 | S | 9/2010 | Benedetti | |
| 7,793,882 | B2 | 9/2010 | Reinsel et al. | |
| 7,795,584 | B2 | 9/2010 | Mok et al. | |
| 7,841,556 | B2 * | 11/2010 | Elliott | A47K 10/3687 242/564.2 |
| 7,878,446 | B2 | 2/2011 | Reinsel et al. | |
| 7,887,005 | B2 | 2/2011 | Troutman et al. | |
| 8,146,471 | B2 * | 4/2012 | Hansen | A47K 10/3643 83/337 |
| 8,468,920 | B2 * | 6/2013 | Hagleitner | A47K 10/3643 83/337 |
| 8,555,761 | B2 * | 10/2013 | Keily | B26D 1/125 83/343 |
| 8,943,938 | B2 * | 2/2015 | Sahlberg | B65H 35/0006 83/295 |
| 9,918,598 | B2 * | 3/2018 | Osborne | A47K 10/38 |
| 2001/0006206 | A1 | 7/2001 | Helfer-Grand | |
| 2002/0073819 | A1 | 6/2002 | Phelps et al. | |
| 2002/0073821 | A1 | 6/2002 | Broehl | |
| 2002/0117578 | A1 | 8/2002 | Denen et al. | |
| 2003/0041716 | A1 | 3/2003 | Takashima | |
| 2003/0132261 | A1 | 7/2003 | Formon et al. | |
| 2003/0168489 | A1 | 9/2003 | Formon et al. | |
| 2003/0222779 | A1 | 12/2003 | Schotz et al. | |
| 2004/0084550 | A1 | 5/2004 | Allen | |
| 2005/0051005 | A1 | 3/2005 | Broehl | |
| 2005/0067424 | A1 | 3/2005 | Duff | |
| 2005/0077419 | A1 | 4/2005 | Thomas et al. | |
| 2005/0145745 | A1 | 7/2005 | Lewis et al. | |
| 2006/0124662 | A1 | 6/2006 | Reynolds et al. | |
| 2006/0175341 | A1 | 8/2006 | Rodrian | |
| 2006/0266784 | A1 | 11/2006 | Kananen | |
| 2007/0010389 | A1 | 1/2007 | Cutrona et al. | |
| 2007/0030145 | A1 | 2/2007 | Marcichow | |
| 2007/0158359 | A1 | 7/2007 | Rodrian | |
| 2007/0176774 | A1 | 8/2007 | Jahrling et al. | |
| 2007/0228066 | A1 | 10/2007 | Almas et al. | |
| 2007/0241160 | A1 | 10/2007 | Kenney | |
| 2007/0272701 | A1 | 11/2007 | Carlsson et al. | |
| 2008/0048064 | A1 | 2/2008 | Lemaire et al. | |
| 2008/0099495 | A1 | 5/2008 | Mok et al. | |
| 2008/0128446 | A1 | 6/2008 | Kuehneman et al. | |
| 2008/0128448 | A1 | 6/2008 | Cittadino et al. | |
| 2008/0164368 | A1 | 7/2008 | Shek | |
| 2008/0190982 | A1 | 8/2008 | Omdoll | |
| 2008/0238665 | A1 | 10/2008 | Peng | |
| 2008/0245922 | A1 | 10/2008 | Fellhoelter | |
| 2009/0101751 | A1 | 4/2009 | Cittadino et al. | |
| 2009/0140001 | A1 | 6/2009 | Lewis et al. | |
| 2009/0195385 | A1 | 8/2009 | Huang et al. | |
| 2009/0198373 | A1 | 8/2009 | Mok et al. | |
| 2009/0218433 | A1 | 9/2009 | Neveu et al. | |
| 2009/0256022 | A1 | 10/2009 | Maurer | |
| 2009/0272836 | A1 | 11/2009 | Byrd et al. | |
| 2009/0314800 | A1 | 12/2009 | Reynolds et al. | |
| 2010/0012675 | A1 | 1/2010 | Formon et al. | |
| 2010/0051737 | A1 | 3/2010 | Rodrian et al. | |
| 2010/0068092 | A1 | 3/2010 | Larsson | |
| 2010/0102101 | A1 | 4/2010 | Keily et al. | |
| 2010/0176237 | A1 | 7/2010 | Friesen et al. | |
| 2010/0219284 | A1 | 9/2010 | Troutman et al. | |
| 2010/0243696 | A1 | 9/2010 | Friesen et al. | |
| 2010/0269653 | A1 | 10/2010 | Larsson | |
| 2011/0133019 | A1 | 6/2011 | Keily et al. | |
| 2013/0192437 | A1 * | 8/2013 | Sahlberg | B65H 35/0006 83/304 |

FOREIGN PATENT DOCUMENTS

| | | | |
|---|---|---|---|
| CN | 2508680 | Y | 9/2002 |
| EP | 235438 | B1 | 1/1991 |
| EP | 235446 | B1 | 10/1992 |
| EP | 629372 | A1 | 12/1994 |
| EP | 522477 | B1 | 10/1995 |
| EP | 693268 | A1 | 1/1996 |
| EP | 579892 | B1 | 3/1996 |
| EP | 901336 | B1 | 5/2001 |
| EP | 1230886 | A1 | 8/2002 |
| EP | 994667 | B1 | 4/2003 |
| EP | 1421888 | A2 | 5/2004 |
| EP | 1455624 | B1 | 11/2005 |
| EP | 1101434 | B1 | 2/2006 |
| EP | 1202924 | B1 | 5/2006 |
| EP | 1290970 | B1 | 10/2007 |
| EP | 1830687 | B1 | 5/2010 |
| EP | 1231823 | B2 | 8/2010 |
| EP | 1816941 | B1 | 11/2010 |
| ES | 2208032 | A1 | 6/2004 |
| GB | 2444649 | A | 6/2008 |
| JP | 11104033 | A | 4/1999 |
| JP | 2004024378 | A | 1/2004 |
| WO | 9117692 | A1 | 11/1991 |
| WO | 9417715 | A1 | 8/1994 |
| WO | 9729671 | A1 | 8/1997 |
| WO | 9745049 | A1 | 12/1997 |
| WO | 9958040 | A1 | 11/1999 |
| WO | 0018284 | A1 | 4/2000 |
| WO | 0063100 | A1 | 10/2000 |
| WO | 0200083 | A1 | 1/2002 |
| WO | 02063582 | A2 | 8/2002 |
| WO | 03051166 | A1 | 6/2003 |
| WO | 03053202 | A1 | 7/2003 |
| WO | 2003078286 | A1 | 9/2003 |
| WO | 2005074532 | A2 | 8/2005 |
| WO | 2005087068 | A1 | 9/2005 |
| WO | 2006054965 | A2 | 5/2006 |
| WO | 2006060047 | A1 | 6/2006 |
| WO | 2006065729 | A2 | 6/2006 |
| WO | 2006071148 | A1 | 7/2006 |
| WO | 2006072006 | A2 | 7/2006 |
| WO | 2007006329 | A1 | 1/2007 |
| WO | 2007006330 | A1 | 1/2007 |
| WO | 2007006331 | A1 | 1/2007 |

(56) References Cited

FOREIGN PATENT DOCUMENTS

| | | | |
|---|---|---|---|
| WO | 2007068269 | A1 | 6/2007 |
| WO | 2007068270 | A1 | 6/2007 |
| WO | 2007098419 | A2 | 8/2007 |
| WO | 2007120415 | A2 | 10/2007 |
| WO | 2008042961 | A2 | 4/2008 |
| WO | 2008042964 | A2 | 4/2008 |
| WO | 2008051744 | A2 | 5/2008 |
| WO | 2008053385 | A1 | 5/2008 |
| WO | 2008063248 | A1 | 5/2008 |
| WO | 2009072055 | A1 | 6/2009 |
| WO | 2010046662 | A1 | 4/2010 |
| WO | 2010121276 | A1 | 10/2010 |
| WO | 2010129742 | A2 | 11/2010 |
| WO | 2013044385 | A1 | 4/2013 |

OTHER PUBLICATIONS

Clean Cut, How to Use—CLEANCut Touchless Paper Towel Dispenser, http://www.cleancutdispenser.com/howtouse/.
Georgia-Pacific Professional, EnMotion®, Wall Mounted Automated Touchless Towel Dispenser.
Impact Products, Towel Dispensers, Wahrooms, p. 41-43.
ITouchless, Automatic Sensor Paper Towel Dispenser, iTouchless.com.
Kimberly-Clark, Kimberly-Clark Professional Electronic Touchless Towel System, http://www.kcprofessional.com/us/mkt/ehrt/.
Palmer Fixture, Electra, www.palmerfixture.com.
San Jamar, Touchless, www.sanjamar.com.
Von Drehle, Quality Towel & Tissue Products since 1974, Fall 2010 Product Catalog, www.vondrehle.com.

* cited by examiner 38
40
50
54
48
56
56
16
49
52

ROLLED PRODUCT DISPENSER WITH MULTIPLE CUTTING BLADES AND CUTTER ASSEMBLY FOR A ROLLED PRODUCT DISPENSER

CROSS-REFERENCE TO RELATED APPLICATIONS

This application claims priority under 35 USC§ 119(e) of U.S. provisional patent application 61/539,028 filed on Sep. 26, 2011, a national phase entry of International patent application PCT/CA2012/050674 filed on Sep. 26, 2012 (now abandoned), and a continuation of U.S. patent application Ser. No. 14/119,633 (now pending), the specifications of which are hereby incorporated by reference.

FIELD OF THE INVENTION

The present invention relates to rolled product dispensers. More particularly, the present invention relates to a rolled product dispenser comprising a multiple blade system operating for cutting a rolled product, such as rolled tissue paper. It also relates to cutter assemblies for rolled product dispensers.

BACKGROUND OF THE INVENTION

Several types and models of rolled product dispensers are currently available on the market, especially for dispensing rolled paper, including, without being limitative, dispensers for paper hand towels, similar to the ones found in public bathrooms. These dispensers are configured for dispensing a web of the rolled product to a user and for cutting the web of rolled product once a desired length has been dispensed. The desired length can either be predetermined or can be controlled by the user of the dispenser.

Several cutting mechanisms are known in the industry and can be included in a dispenser for cutting the rolled product. One of the most common cutting mechanisms is a fixed blade having a serrated edge against which the user can pull the web of rolled product to tear a desired length of rolled product.

Also known in the art are dispensers where a user pulls a free end of the rolled product and the rolled product is automatically cut after a predetermined length has been dispensed. These dispensers are known in the industry as "no-touch" or "touchless" dispensers. The cutting mechanism of such dispensers usually includes a rotating drum having a cutting blade pivotally mounted within the drum. The rolled product is superposed to at least a section of an outer surface of the drum. When a user pulls the free end of the rolled product, the web of rolled product is pulled over the drum and the drum is caused to rotate. The rotation of the drum engages a blade guiding assembly causing the cutting blade to extend through a slot formed on the drum, and thereby severs the rolled product. In different embodiments, the blade guiding assembly can be a cam system, a spring system, a rotatory support system, a crank assembly or a combination thereof.

Examples of such dispensers can be found in U.S. Pat. No. 6,684,751 to Kapiloff et al., U.S. Pat. No. 6,609,449 to Granger, U.S. Pat. No. 6,591,727 to Purcell et al., U.S. Pat. No. 6,553,879 to Morand, U.S. Pat. No. 7,168,602 to Broehl, U.S. Pat. No. 7,357,348 to Kananen, U.S. Pat. No. 6,363,825 to Hagleitner, U.S. Pat. No. 7,841,556 to Elliott et al., as well as published US application No. 2007/0010389 to Cutrona et al.

All the dispensers disclosed in the above-mentioned references use a single blade for severing the web of rolled product. A consequence of the above described configuration is that a high pressure is normally applied on the single blade during the severing of the rolled product, which can create problems with "tabbing". Tabbing occurs when a piece of towel tears off the sheet when a user grasps and pulls the paper. It has been found that tabbing occurs when, for instance, the blade tries to cut the web of paper. Lowering the pressure applied on the blade can reduce tabbing problems.

In light of the above, there is presently a need for an improved rolled product dispenser which, by virtue of its design and components, would be able to overcome or at least minimize some of the above-discussed prior art problems.

SUMMARY OF THE INVENTION

According to a general aspect, there is provided a rolled product dispenser for dispensing a web of rolled product. The rolled product dispenser comprises a housing; a dispensing assembly at least partially housed in the housing and interacting with the web of the rolled product; and a cutting assembly cooperating with the dispensing assembly to sever the web of rolled product. The cutting assembly comprises at least two cutting blades, each one of the cutting blades having a first end and a second end. The first end is pivotally mounted and the second end is operationally connected to a guiding assembly for guiding the blade between a cutting position and a non-cutting position.

In an embodiment, at least two of the at least two cutting blades are mounted in an inverted configuration.

In an embodiment, the at least two cutting blades move simultaneously between the cutting position and the non-cutting position.

In an embodiment, the at least two cutting blades move successively between the cutting position and the non-cutting position.

In an embodiment, the guiding assembly comprises at least one guiding groove. The second end of each one of the at least two cutting blades can be inserted into a corresponding one of the at least one guiding groove.

In an embodiment, the at least one guiding groove forms a closed loop.

In an embodiment, the simultaneous movements of the at least two cutting blades between the cutting position and the non-cutting position result from at least two of the at least one guiding groove having a similar configuration and a similar orientation.

In an embodiment, the successive movements of the at least two cutting blades between the cutting position and the non-cutting position result from at least two of the at least one guiding groove presenting at least one of a different configuration and a different orientation.

In an embodiment, the dispensing assembly comprises a rotating drum.

In an embodiment, the cutting assembly comprises a first cutting blade and a second cutting blade. The first cutting blade is brought in the cutting position when a rotation angle of the rotating drum is between 0 and 20 degrees. The second cutting blade is brought in the cutting position when the rotation angle of the rotating drum is between 20 and 30 degrees.

In an embodiment, the rolled product dispenser further comprises a rotating drum cover configurable in a closed configuration and an open configuration. The rotating drum cover is superposed to at least a section of a peripheral wall of the rotating drum in the closed configuration, with the web of rolled product being extendable therebetween. The rotating drum cover is spaced-apart from the peripheral wall of the rotating drum in the opened configuration.

In an embodiment, the rotating drum cover further comprises a tensioning member for biasing the web of rolled product towards the peripheral wall of the rotating drum, when configured in the closed configuration.

In an embodiment, the at least two cutting blades have a length which substantially corresponds to a length of the cutting assembly.

According to another general aspect, there is provided a rolled product dispenser comprising a housing and at least two longitudinally extending cutting blades pivotally mounted inside the housing. The at least two longitudinally extending cutting blades are configurable between a non-cutting position and a cutting position. Each one of the cutting blades has a pivotally mounted proximal end and a distal end. The distal end of a first one of the cutting blades is opposed to the distal end of a second one of the cutting blades. In the cutting position, the distal end of the cutting blades is spaced-apart transversally from its proximal end.

According to another general aspect, there is provided a rolled product dispenser for dispensing a web of rolled product. The rolled product dispenser comprises a housing and at least two longitudinally extending cutting blades pivotally mounted inside the housing. The at least two longitudinally extending cutting blades are configurable between a non-cutting configuration and a cutting configuration. Each one of the cutting blades has a pivotal end and a distal end. The distal end is movable transversally for configuring the cutting blade successively in the non-cutting configuration and the cutting configuration. The distal end of a first one of the cutting blades is opposed longitudinally to the distal end of a second one of the cutting blades.

According to another general aspect, there is provided a cutting assembly for a rolled product dispenser with a housing. The cutting assembly comprises at least two longitudinally extending cutting blades pivotally mountable inside the housing and configurable between a non-cutting configuration and a cutting configuration. Each one of the cutting blades has a pivotal end and a distal end. The distal end is movable transversally for displacing the cutting blade between the non-cutting configuration and the cutting configuration. The distal end of a first one of the cutting blades is opposed to the distal end of a second one of the cutting blades.

In an embodiment, the at least two longitudinally extending cutting blades of the cutting assembly are configured to be mountable inside a rotating drum at least partially housed in the housing of a rolled product dispenser.

In an embodiment, the distal end of each one of the cutting blades comprises a male member insertable into a complementary female member forming a guiding assembly.

In an embodiment, the female member is a guiding groove and the guiding groove forms a closed loop.

According to another general aspect, there is provided a cutting assembly for a rolled product. The cutting assembly comprises at least two longitudinally extending cutting blades pivotally mountable and configurable between a non-cutting configuration and a cutting configuration. Each one of the cutting blades has a pivotal end and a distal end movable transversally for displacing the cutting blade between the non-cutting configuration and the cutting configuration.

According to still another general aspect, there is provided a cutting assembly for a rolled product. The cutting assembly comprises at least two longitudinally extending cutting blades pivotally mountable and configurable between a non-cutting configuration wherein the blades are spaced-apart from the rolled product and a cutting configuration wherein the blades are engaged with the rolled product.

In an embodiment, the cutting blades have a longitudinal axis and each one of the cutting blades is pivotable about its longitudinal axis.

In an embodiment, the wherein the at least two cutting blades are configured to move simultaneously between the cutting configuration and the non-cutting configuration. In an alternative embodiment, the at least two cutting blades are configured to move successively between the cutting configuration and the non-cutting configuration.

The cutting assembly can be used in combination with a rotating drum, wherein the at least two longitudinally extending cutting blades of the cutting assembly are pivotally mounted to a periphery of the rotating drum. In an embodiment, the at least two longitudinally extending cutting blades extend substantially tangential to the periphery of the rotating drum in the non-cutting configuration and substantially normal to the periphery of the rotating drum in the cutting configuration. In an embodiment, the at least two longitudinally extending cutting blades are configured in an adjacent and successive configuration to the periphery of the rotating drum.

DETAILED DESCRIPTION

It will be noted that in the following description, the same numerical references refer to similar elements. The embodiments, geometrical configurations, materials mentioned and/or dimensions shown in the figures or described in the present description are preferred embodiments only, given solely for exemplification purposes. Moreover, it will be appreciated that positional descriptions such as "upward", "downward", "forward", "backward", "above", "below", "left", "right" and the like should, unless otherwise indicated, be taken in the context of the figures and should not be considered limiting.

Figure 1:
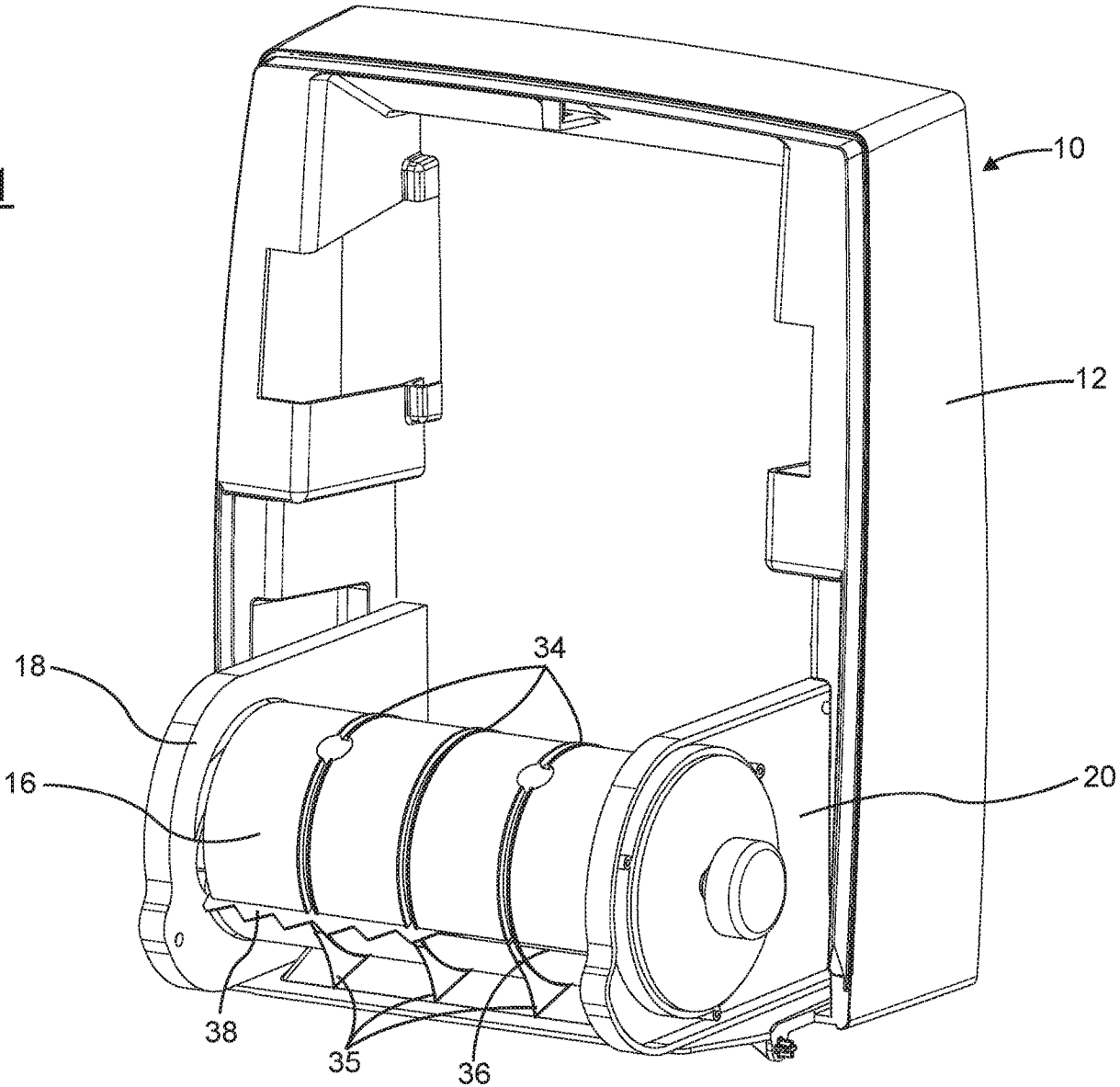
FIG. 1 is a front perspective view of a rolled product dispenser including a rotating drum, presented in an opened configuration, according to an embodiment wherein a first blade mounted in the rotating drum is in the cutting position.
Figure 2:
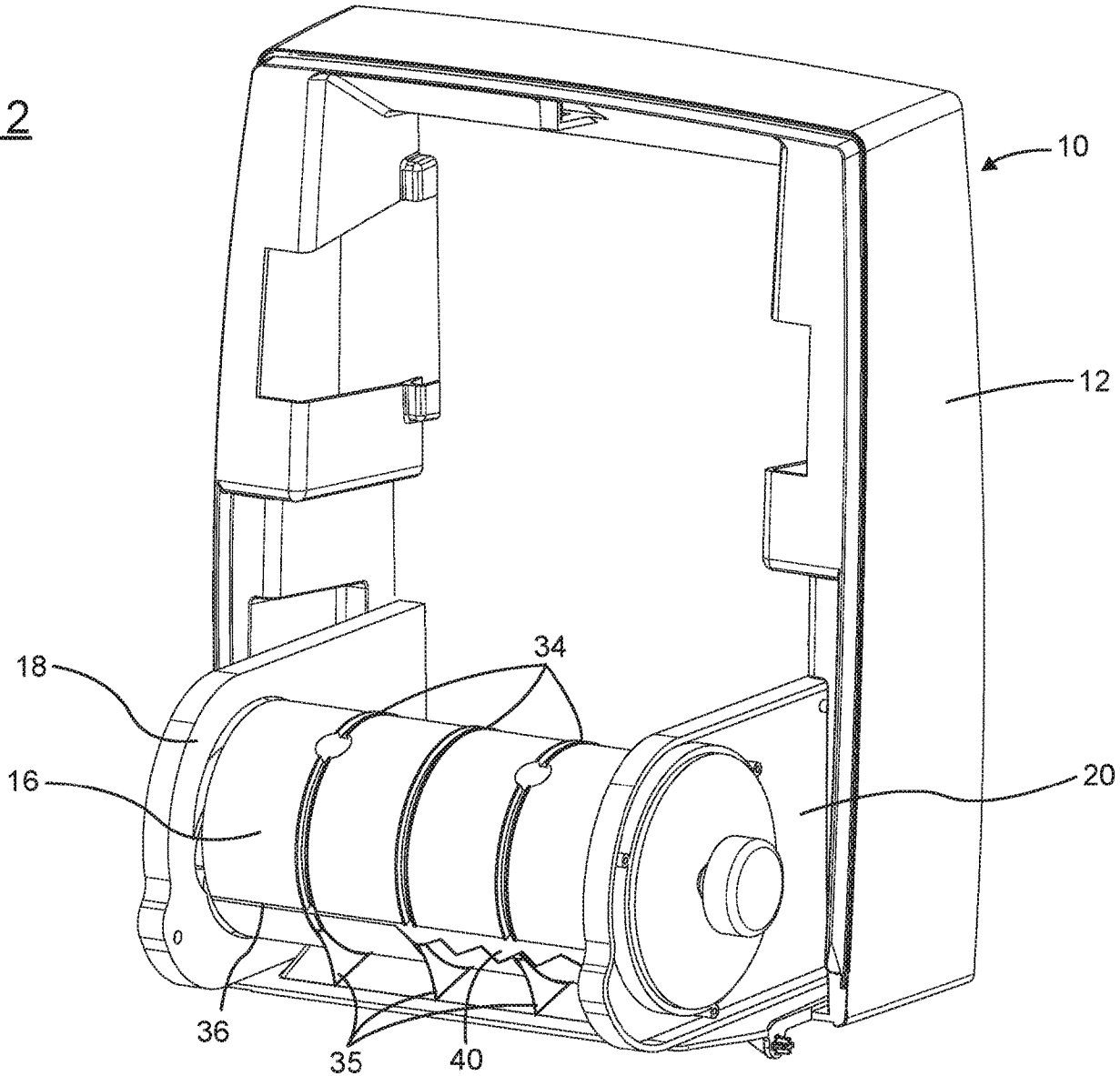
FIG. 2 is a front perspective view of the rolled product dispenser of FIG. 1, wherein a second blade mounted in the rotating drum is in the cutting position.
Figure 3:
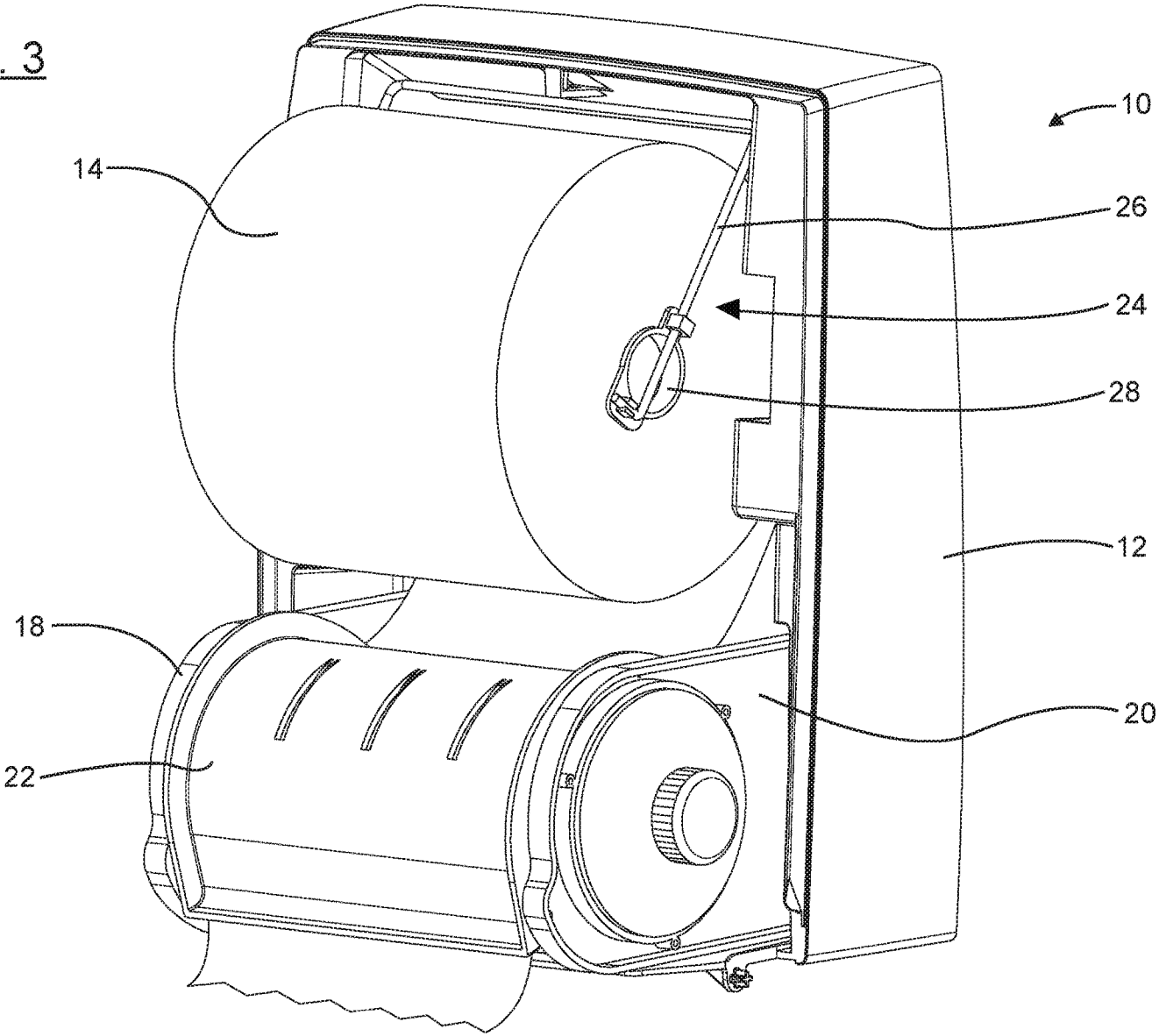
FIG. 3 is a front perspective view of the rolled product dispenser according to an embodiment wherein the rolled product dispenser is provided with a cover for covering a rotating drum.

Referring now to the drawings and, more particularly, referring to FIGS. 1 to 3, there is shown an embodiment of a rolled product dispenser 10 including a housing 12, configured to contain a rolled product 14 such as, but without being limitative, hand paper (or paper towel), and a rotating drum 16, mounted between supporting members 18 and 20, and configured to dispense lengths of a rolled product to a user. A protective cover (not shown in the appended figures) can be provided at the front of the housing, in order to cover the internal components of the dispenser 10. The cover can be removably mounted to the housing using known mounting techniques such as clips, screws or the like. As will be easily understood by one skilled in the art, the rolled product 14 can be paper hand towel. However, the rolled product 14 could be any type of paper provided in a roll, such as, but without being limitative, toilet paper, or other types of rolled product, such as cling film, foil or the like.

In an embodiment, and without being limitative, the housing 12 is made of moulded plastic such as acrylonitrile butadiene styrene (ABS). However, other materials offering similar characteristics could be used in the construction of the housing 12. Moreover, even though the illustrated embodiment presents the supporting members 18 and 20 as being detachably mounted on the housing 12, one skilled in the art will easily understand that the supporting members 18 and 20 could be integral to the housing 12.

Referring to FIG. 3, in an embodiment, the dispenser 10 comprises a roll support 24 for supporting the rolled product 14. In a non-limitative embodiment, the roll support 24 comprises a structure presenting two arms pivotally mounted to the housing 12, where an arm 26 extends on each side of the rolled product 14 and a connector 28, mounted on the arm 26, connects with the rolled product 14 by projecting into the central bore of the rolled product 14. The flexibility of the arms 26 allows the roll support 24 to be easily spread open in order to refill the dispenser 10 with a new roll of rolled product 14, when necessary. As will be easily understood by one skilled in the art, in alternative embodiments, other types of roll supports, providing adequate support to the rolled product 14 and easy refill of the dispenser 10 could be used in connection with the present dispenser 10.

Figure 4:
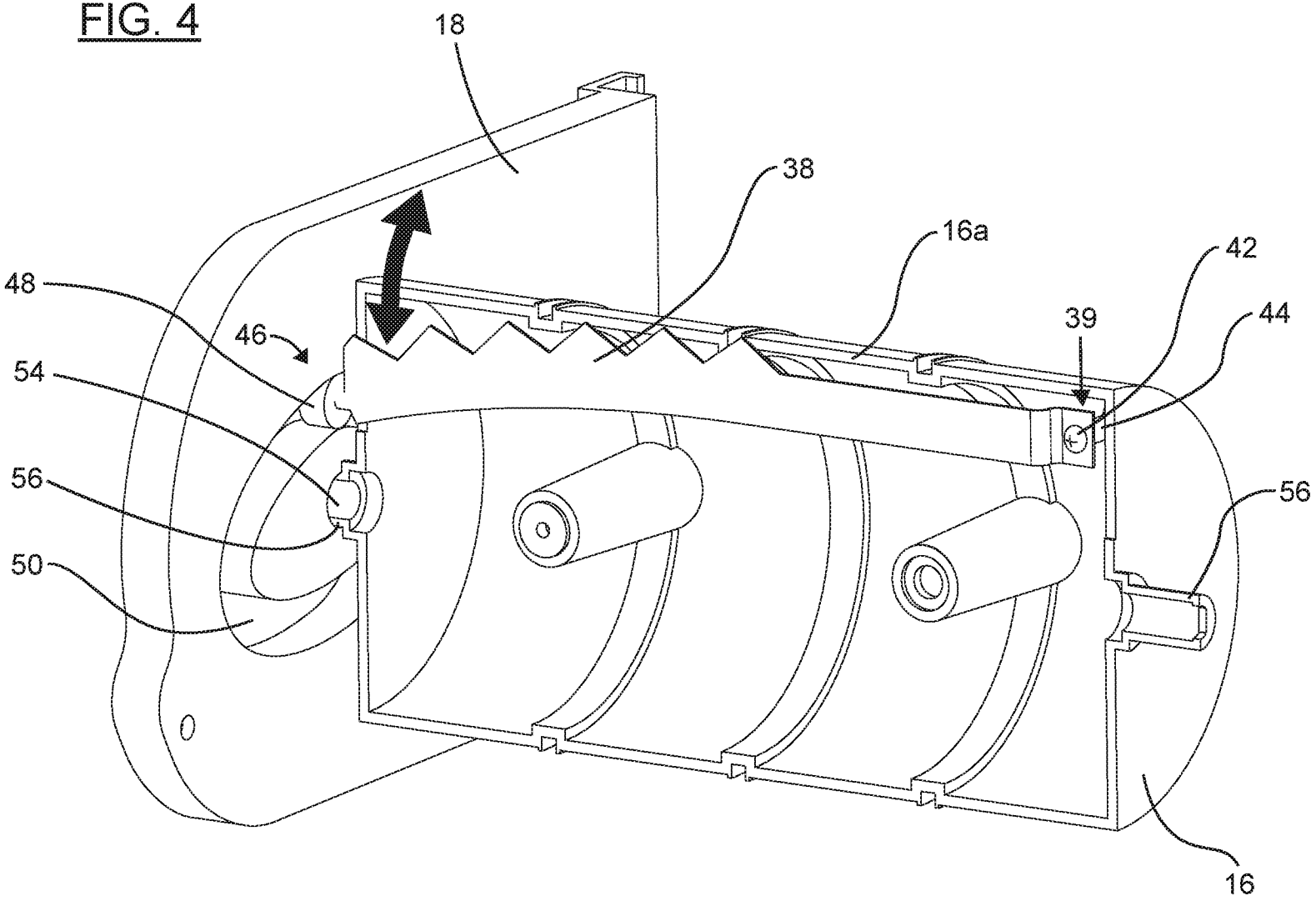
FIG. 4 is a cross-sectional front view of the rotating drum of the rolled product dispenser according to an embodiment of the invention, wherein only one of the two blades and a corresponding blade guiding assembly are shown.

As mentioned above, in an embodiment, the dispenser 10 is provided with a rotating drum 16 mounted between supporting members 18 and 20. As shown in FIG. 4, the rotating drum 16 may be rotatably mounted between the supporting members 18, 20 using projections 56 located at both ends of the rotating drum 16, and extending into complementary attachment cavities 54 formed into the supporting members 18, 20.

As shown in FIGS. 1 and 2, the peripheral wall 16*a* of the rotating drum 16 can be made of a friction-enhanced material (or anti-skid material) in order to increase the traction between the rotation drum 16 and the web of rolled product 15. The rotating drum 16 may also be provided with annular grooves 34 running along its periphery. In an embodiment, stripper guides 35 can be mounted to the housing and engaged with the annular grooves 34. If the web of rolled product 15 remains in contact with the rotating drum 16 during rotation about the drum 16, the stripper guides 35 will strip the web of rolled product 15 from the drum 16 once the web contacts the stripper guides 35. The combination of the annular grooves 34 and the stripper guides 35 avoids the web returning into the housing 12.

Figure 7:
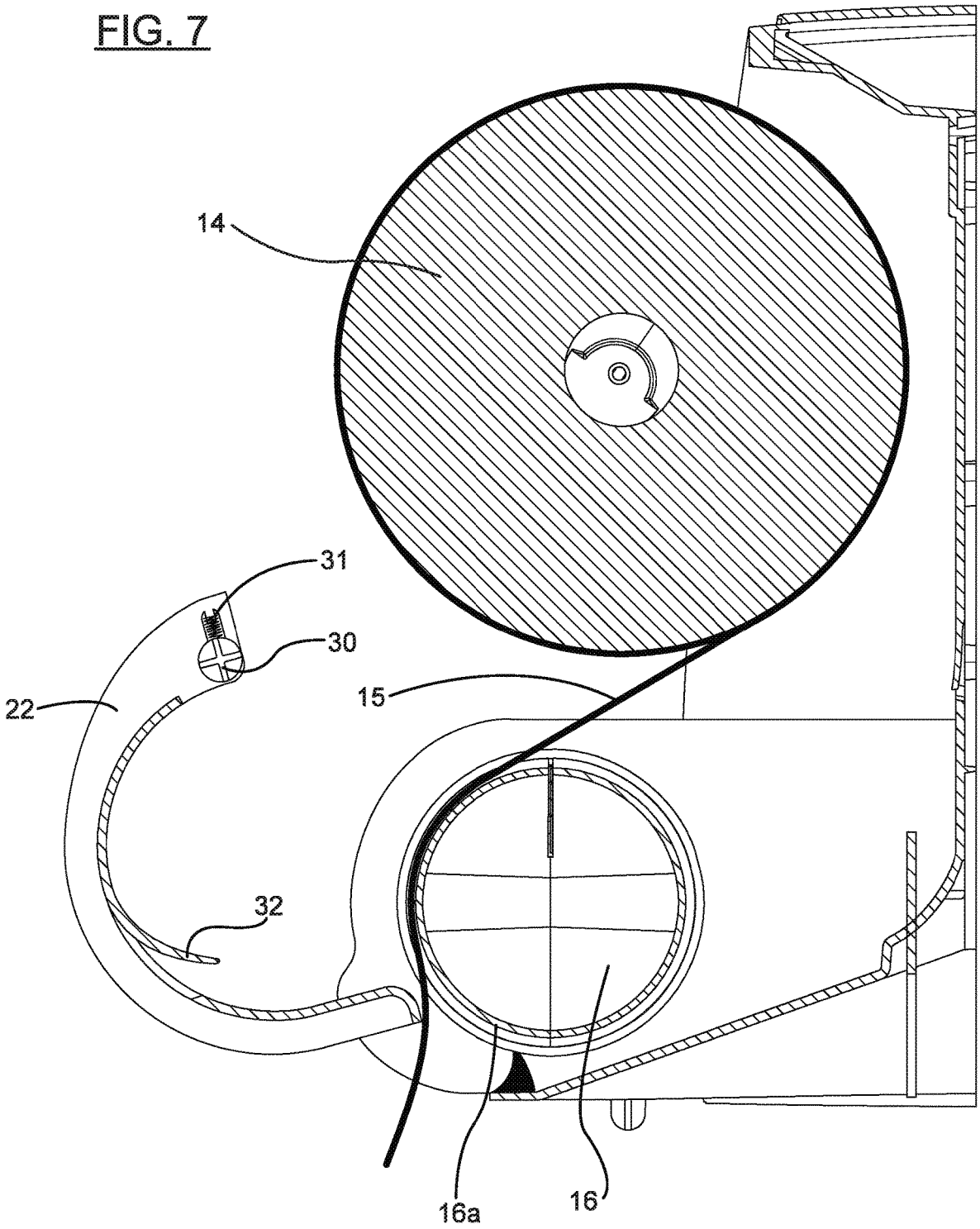
FIG. 7 is a cross-sectional side view of the rolled product dispenser of FIG. 3, wherein the rotating drum cover is shown in an opened configuration.
Figure 8:
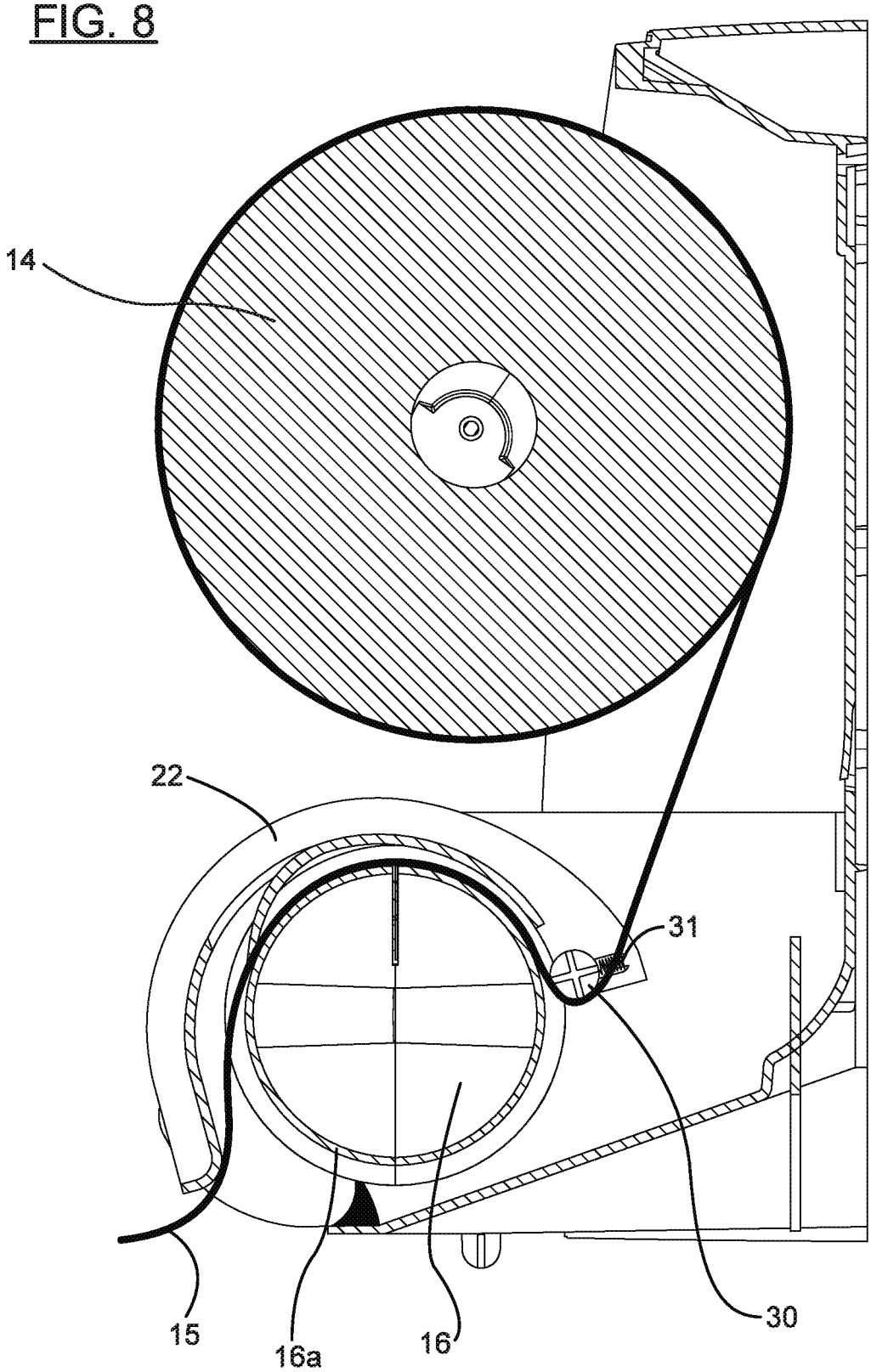
FIG. 8 is another cross-sectional side view of the rolled product dispenser of FIG. 3, wherein the rotating drum cover is shown in a closed configuration.

In an embodiment better shown in FIGS. 3, 7 and 8, and without being limitative, the dispenser 10 is further provided with a cover 22 for covering the rotating drum 16. The cover 22 is hingedly mounted between the supporting members 18 and 20. Therefore, when in the opened configuration, shown in FIG. 7, the cover 22 allows easy access to the rotating drum 16, which facilitates the refill of the dispenser with a new roll of rolled product 14 as well as the maintenance of the cutting assembly, when necessary.

However, when the cover 22 is in the closed configuration, shown in FIG. 8, it covers the front and top portions of the peripheral wall 16*a* of the rotating drum 16, thereby maintaining the web of rolled product 15 against the rotating drum 16 and providing protection against the cutting blades of the cutting assembly. To further maintain the web of rolled product 15 tightly against the rotating drum 16, the cover 22 may also include a tensioning roller 30 mounted to the cover 22 through a biasing member 31, such as a spring member, which pulls the web of rolled product 15 downwards towards the back portion of the rotating drum 16, therefore resulting in the web of rolled product 15 being pulled against the top portion of the rotating drum 16. Thus, when the cover 22 is placed in the closed configuration, the tensioning roller 30 pulls the web of rolled product 15 rearwardly in the housing 12 and against the top portion of the rotating drum 16.

Furthermore, in the illustrated embodiment, a biasing arm 32 extends downward from the cover 22 and drives the web of the rolled product 15 against the peripheral wall 16*a* of the rotating drum 16. The above mentioned assembly results in the rotating drum 16 rotating at the same speed as the web of rolled product 15 during dispensing and that no slippage occurs.

Now referring to FIGS. 1 and 2, in an embodiment, the rotating drum 16 is provided with a longitudinal slot 36 extending along the entire length of the rotating drum 16. As will be described in more details below, during the rotation of the rotating drum 16, a first cutting blade 38 and a second cutting blade 40 of the cutting assembly extend momentarily from the longitudinal slot 36, outside of the rotating drum 16, thereby providing the cutting capabilities of the dispenser 10. To that effect, FIG. 1 shows the first cutting blade 38 extending from the longitudinal slot 36 and FIG. 2. shows the second cutting blade 40 extending from the longitudinal slot 36. As can be seen, the first cutting blade 38 and the second cutting blade 40 extend longitudinally inside the rotating drum 16. In the course of the present document, the term longitudinally will be used in reference to elements positioned along the length of the rotating drum 16, thereby being positioned along the width of the web of rolled product 15.

FIG. 4 shows in more details an embodiment of the mechanism which allows the cutting blades 38 and 40 to move transversally and thereby extend out of the rotating drum 16 and retract inside of it. In the course of the present document, the term transversally will be used in reference to elements moving perpendicularly to the longitudinal orientation of the cutting blades 38, 40, in a direction towards the web of rolled product 15.

It should be understood that, for the sake of clarity, FIG. 4 only shows the first cutting blade 38, along with its corresponding mechanism, but that the dispenser, according to the illustrated embodiment, comprises two cutting blades 38 and 40, each blade having its own mechanism. Furthermore, one skilled in the art will easily understand that, in alternative embodiments, additional cutting blades could be provided. As can be seen, in an embodiment, a first end 39, known as the pivotal end or the proximal end of the cutting blade 38, is pivotally mounted to the rotating drum 16 using a pin or screw 42 traversing an aperture formed in the blade 38 and subsequently engaging a fixation element 44. In alternative embodiments, other known fixation means ensuring that the pivotal end 39 of the blade 38 can freely pivot or rotate could also be used to pivotally attach the pivotal end 39 of the blade 38 to the rotating drum 16.

In the illustrated embodiment, the second end 46 of the blade 38, known as the guiding end or distal end, is provided with a male member. In an embodiment, the male member is a free rolling assembly 48 which for example and without being limitative, the free rolling assembly can be a ball bearing system. The free rolling assembly 48 projects longitudinally outside of the rotating drum 16 into a female member formed within the corresponding supporting member 18. In the illustrated embodiment, the female member is a guiding groove 50 forming a closed looped groove carved into the supporting member 18, around the attachment cavity 54, and having an egg-like shape. As the rotating drum 16 rotates, as a consequence of the pulling of the free end of the rolled product 14 by a user, the free rolling assembly 48 of the guiding end 46 of the blade 38 moves along the path of the guiding groove 50. The egg-like shape of the guiding groove 50 drives the blade to move longitudinally up and down during the rotation of the rotating drum 16.

In alternative embodiments and without being limitative, the male member, embodied in the illustrated embodiments by the free rolling assembly 48, can be replaced by other types of path or cam followers, such as a sliding member engaged in the guiding groove 50.

Although not illustrated in FIG. 4, the second cutting blade 40 is similar to the first cutting blade 38 and presents the same configuration as the one described in connection with the first cutting blade 38. However, in the illustrated embodiment, the second cutting blade 40 is inverted with respect to the orientation of the first cutting blade 38, i.e. the pivotal end 39 of the first cutting blade 38 is located proximate to the guiding end 47 of the second cutting blade 40 and vice versa. A second guiding groove 52 is carved into the second supporting member 20 and receives the free rolling assembly 49 of the guiding end 47 of the second blade 40, in order to allow the second cutting blade 40 to also move between the retracted non-cutting position and the extended cutting position. One skilled in the art will understand that, in alternative embodiments, the first cutting blade 38 and the second cutting blade 40 could be oriented similarly, their pivotal end being proximate to one another.

In an embodiment, the cutting blades 38, 40 are made of metal or plastics in order to be rigid enough to sever the rolled product and provide sufficient wear resistance. One skilled in the art will however readily understand that, in alternative embodiments, other material could be used. Moreover, the edge of the cutting blades 38, 40 which contacts the web of rolled product 15 can be serrated in order to facilitate the severing of the web of rolled product 15. The amount of teeth provided on the serrated blades may vary from the illustrated embodiment where five teeth are provided. One skilled in the art will also understand that, in alternative embodiments, multiple blades having a different amount of teeth may be used as part of a single cutting assembly.

Figures 5A, 5B, 5C:
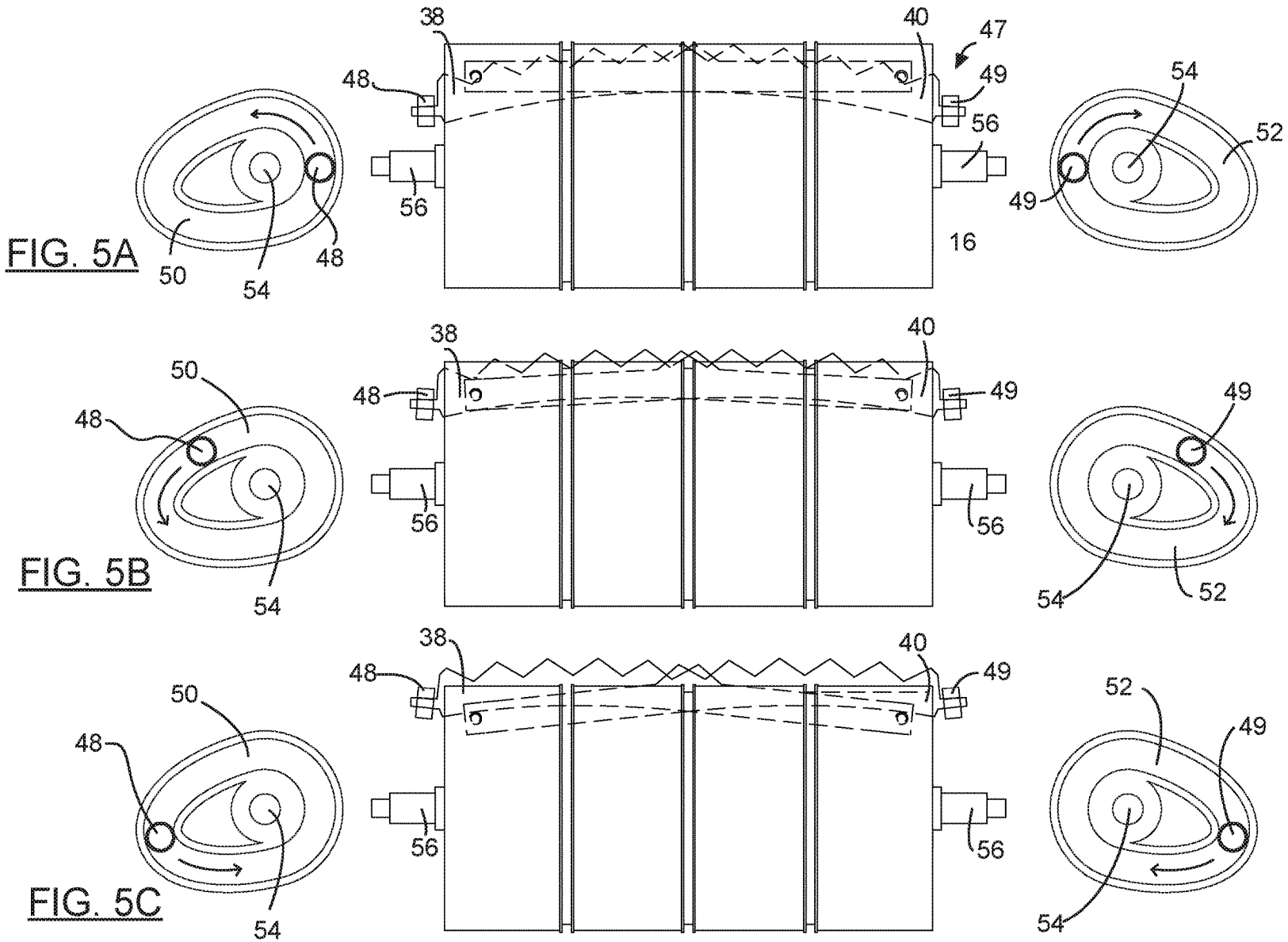
FIGS. 5A-5C are schematic representations of successive configurations of the guiding assemblies of each blade, along with the corresponding positioning of the blades within the rotating drum, according to an embodiment wherein the blades are configured in a cutting position simultaneously.

As better illustrated in FIG. 5A to FIG. 5C, the movement of the free rolling assemblies 48, 49 of the guiding ends 46, 47 of the blades 38, 40, along the guiding grooves 50, 52, causes each blade 38, 40 to move transversally between a retracted non-cutting position, where the blade is contained within the longitudinal slot 36 and does not extend outward of the rotating drum 16 (as shown in FIG. 5A) and an extended cutting position where the blade extends perpendicularly from the longitudinal slot 36 of the rotating drum 16 (as shown in FIG. 5C). The cutting blades 38, 40 reach several intermediate positions between the above described cutting and non-cutting positions. Such an intermediate position is shown in FIG. 5B where the cutting blades extend from the rotating drum 16, but not to their full extent as to sever the web of rolled product 15.

In the illustrated embodiment, the level of the cutting blades 38, 40 is dictated by the distance between the free rolling assemblies 48, 49 and the corresponding attachment cavity 54 at a given point in time. For example, the blades 38, 40 will be at their lowest when the distance between the free rolling assemblies 48, 49 and the corresponding attachment cavity 54 is the shortest. Similarly, the peak of the extended cutting position will be reached when the free rolling assemblies 48, 49 are positioned at the point farthest from the corresponding attachment cavity 54. In the presented embodiment, the position of the attachment cavity 54 and the egg-like configuration of the guiding grooves 50, 52 result in the cutting blades remaining in the lowered non-cutting position for a portion of a revolution of the rotating drum 16 that is significantly longer than the extended cutting position. This configuration provides the desired brief extension of the cutting blades 38, 40 outside of the rotating drum 16 during a rotation of the rotating drum 16, for severing the web of roll product 15.

In an alternative embodiment, the configuration of the guiding grooves 50, 52 may be different than the illustrated egg-like configuration. For example and without being limitative, the guiding grooves 50, 52 may present an eccentric rounded configuration. In another alternative embodiment, the guiding grooves 50 and 52 may even present a different configuration from one another.

In FIGS. 5A-5C, the guiding grooves 50, 52 present a similar orientation and configuration. Consequently, the movement of the cutting blades is similar, i.e. the blades 38, 40 are raised and lowered simultaneously as can be seen from the sequence of operation of FIGS. 5A-5C. However, in an alternative embodiment and as can be seen in FIGS. 6A-6E, the orientation of the first and second guiding grooves 50, 52 can be different. This difference in orientation leads to the blades 38, 40 being raised successively, rather than simultaneously. It should be understood that the term "successively" is used herein to mean that the blades 38, 40 may be raised according to a different timing. It should not be construed narrowly to be restricted to the blades being raised solely one after the other or one blade being stationary when the other is moving. In an alternative embodiment, consecutive movement may be caused by the first and second guiding grooves 50, 52 presenting a different configuration. As a consequence, the speed at which the blades are moved between the retracted non-cutting position and the extended cutting position may also be different.

Figures 6A, 6B, 6C, 6D, 6E:
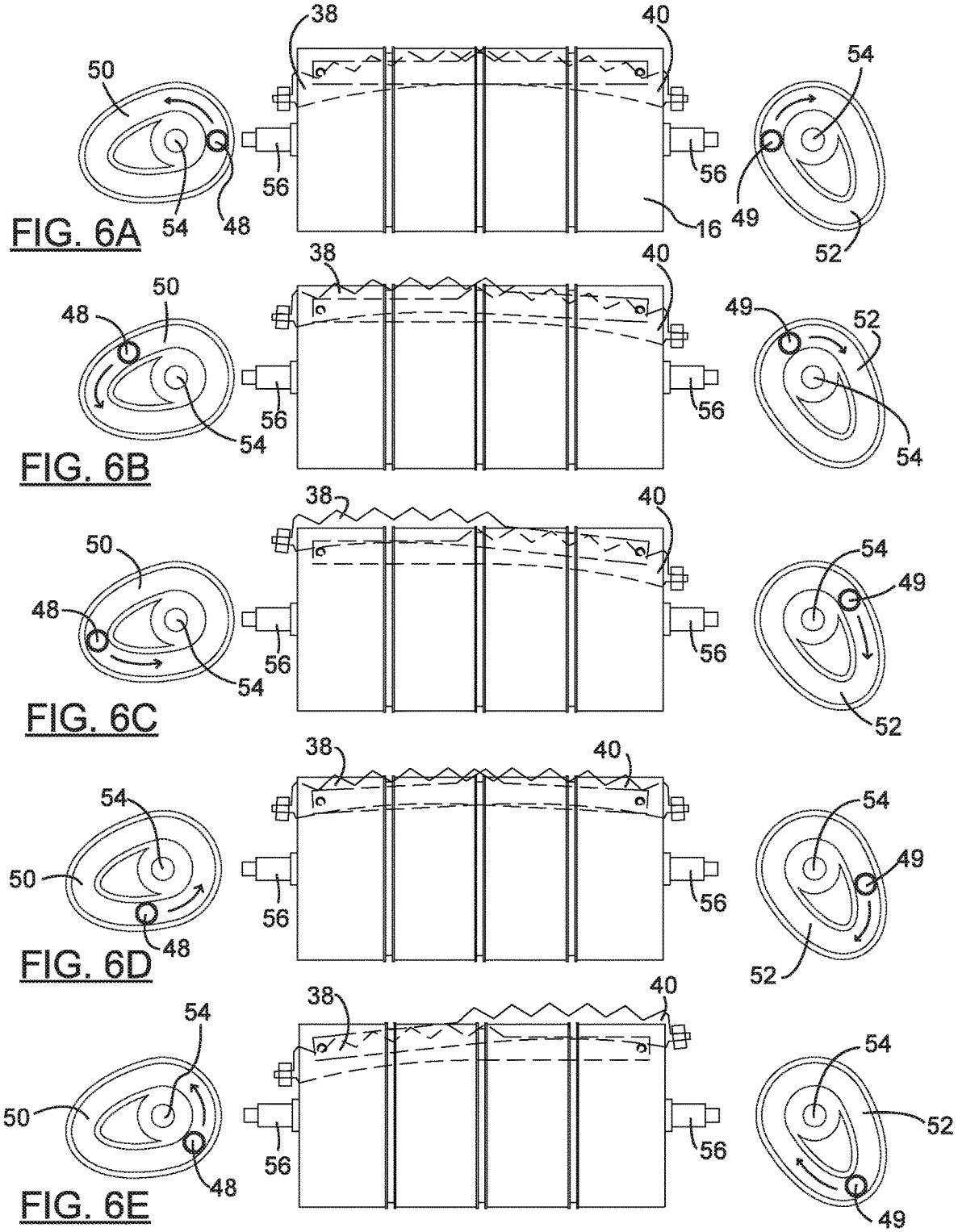
FIGS. 6A-6E are schematic representations of successive configurations of the guiding assemblies of each blade, along with the corresponding positioning of the blades within the rotating drum, according to another embodiment wherein the blades are configured in a cutting position consecutively.

A sequence of operation of the first cutting blade 38 and the second cutting blade 40, according to one embodiment, is illustrated in FIG. 6A to FIG. 6E, where subsequent positions of the cutting blades 38, 40, during a revolution of the rotating drum 16, are presented. FIG. 6A presents both blades 38, 40 in the non-cutting position. In FIG. 6B the first cutting blade 38 is starting to extend towards the cutting position, while the second blade 40 still remains in the non cutting position. FIG. 6C presents the first blade 38 in the cutting position, while the second cutting blade 40 still remains in the non-cutting position. In FIG. 6D, the first blade 38 is retracting towards the non-cutting position, while the second blade 40 is extending towards the cutting position. Finally, in FIG. 6E, the first blade 38 is in the non-cutting position, while the second blade 40 is in the cutting position.

In the illustrated embodiment, the sequence of operation of the first cutting blade 38 and the second cutting blade 40 is directly related to the rotative movement of the rotating drum 16. Therefore, the movement of the blades 38, 40 can be defined in relation with the rotation angle of the rotating drum 16. For example and without being limitative, the first cutting blade 38 can be brought in the cutting position when the rotation angle of the rotating drum 16 is between 0 and 20 degrees from a starting rest position and the second cutting blade can be brought in the cutting position when the rotation angle of the rotating drum is between 20 and 30 degrees from the starting rest position. As will be easily understood, in an alternative embodiment, other alternative sequences may be provided.

It will be understood that the guiding assembly used to guide the cutting blades 38, 40 between the retracted non-cutting position and the extended cutting position is not limited to the above described embodiment. In fact, one skilled in the art will readily understand that any guiding assembly resulting in the raised and lowered movement of the guiding ends 46, 47 of the blades 38, 40, in order to move the blades 38, 40 between a non-cutting and a cutting position, simultaneously or consecutively, could be used. For example and without being limitative, a cam or a spring system could also be used for forming the guiding assembly.

In an alternative embodiment and without being limitative, a dispenser having at least two longitudinally extending cutting blades, pivotally mounted inside the housing and configurable between a non-cutting position and a cutting position, could be provided without the need of a rotating drum or any roller assembly. In such an embodiment, the movement of the cutting blades between a non-cutting position and a cutting position may be activated by an activation mean such as, without being limitative, a push button or a sensor sensing that a predetermined length of paper has been dispensed.

In another alternative embodiment and without being limitative, a cutting assembly comprising at least two cutting blades having the characteristics described in the present description to be configurable between a non-cutting position and a cutting position, could be provided independently from the dispenser in which it is destined to be installed into.

In an alternative embodiment, the cutting blades can be shorter than the width of the web of rolled product being cut and the two or more cutting blades can be disposed successively along the longitudinal axis of the rotating drum, if any, or along the width of the rolled product web. The pivotable end of the cutting blades can be anywhere along the width of the rolled product web. For instance and without being limitative, if the cutting assembly includes two cutting blades mounted sequentially in an adjacent configuration, their pivotable end can be provided at opposed or adjacent ends thereof (for instance, in the middle of the width of the web). Furthermore, in an alternative embodiment, the cutting blades can pivot about their longitudinal axis, instead of having a pivotable end. For instance and without being limitative, the blades can pivot between the non-cutting position wherein they extend substantially parallel to the web or tangential to the rotating drum, if any, and a cutting position wherein they extend substantially perpendicularly to the web or normal to the periphery of the rotating drum. For instance, the cutting blades can be mounted to a periphery of the rotating drum and rotate therewith. Once again, the cutting blades can be configurable into the cutting position either sequentially or simultaneously. Combinations of the above-described embodiments can also be foreseen.

Furthermore, if the cutting blades are configured sequentially in the cutting position, a first one of the cutting blades can first engage the web without cutting the web entirely and a second one of the cutting blades can then completely sever the web. Thus, the two cutting blades cooperate to completely sever the web and the pressure applied on both blades is thus reduced.

Moreover, even though the presented embodiments are for a "touchless" dispenser, one skilled in the art will easily understand that the cutting assembly could be designed in order to work with a traditional dispenser where a user activates the cutting mechanism after a desired length of rolled paper product has been dispensed.

Several alternative embodiments and examples have been described and illustrated herein. The embodiments of the invention described above are intended to be exemplary only. A person of ordinary skill in the art would appreciate the features of the individual embodiments, and the possible combinations and variations of the components. A person of ordinary skill in the art would further appreciate that any of the embodiments could be provided in any combination with the other embodiments disclosed herein. It is understood that the invention may be embodied in other specific forms without departing from the spirit or central characteristics thereof. The present examples and embodiments, therefore, are to be considered in all respects as illustrative and not restrictive, and the invention is not to be limited to the details given herein. Accordingly, while the specific embodiments have been illustrated and described, numerous modifications come to mind without significantly departing from the scope of the invention.

The invention claimed is:

1. A rolled product dispenser for dispensing a web of rolled product having a web width, the rolled product dispenser comprising:

a housing;

a dispensing assembly at least partially housed in the housing, interacting with the web of rolled product, and comprising a rotating drum having a drum length;

a cutting assembly cooperating with the dispensing assembly to cut the web of rolled product along the web width, the cutting assembly comprising at least two longitudinally extending cutting blades and a guiding assembly, each one of the at least two longitudinally extending cutting blades being at least partially contained in the rotating drum and having a pivotal end and a distal end with a cutting edge provided between the pivotal and distal ends, the pivotal end of each one of the at least two longitudinally extending cutting blades being pivotally mounted to the rotating drum to pivot about a pivoting axis and the distal end of each one of the at least two longitudinally extending cutting blades being operationally engaged with the guiding assembly for guiding the respective one of the at least two longitudinally extending cutting blades between a cutting position and a non-cutting position, the at least two longitudinally extending cutting blades overlapping each other longitudinally along at least a section thereof, wherein the cutting edges are configured to cooperate to engage the web along the web width along a same cut-line.

2. The rolled product dispenser of claim 1, wherein the cutting edge of each one of the at least two longitudinally extending cutting blades extends along a section thereof located between the pivotal end and the distal end.

3. The rolled product dispenser of claim 2, wherein the section of the at least two longitudinally extending cutting blades including the cutting edge is located adjacent to the distal end thereof and each one of the cutting edge comprises a serrated edge extending about half of the drum length.

4. The rolled product dispenser of claim 1, wherein the pivotal ends of at least two of the at least two longitudinally extending cutting blades are opposed longitudinally, the distal ends of the at least two longitudinally extending cutting blades extend outwardly of the rotating drum, the rotating drum comprises a housing and the pivotal ends of the at least two longitudinally extending cutting blades are pivotally mounted to the housing.

5. The rolled product dispenser of claim 1, wherein the pivotal ends of at least two of the at least two longitudinally extending cutting blades are opposed longitudinally, the distal ends of the at least two longitudinally extending cutting blades extend outwardly of the rotating drum, the rotating drum comprises a housing and at least one fixation element extending inwardly of the housing and the pivotal ends of the at least two longitudinally extending cutting blades are pivotally mounted to the at least one fixation element.

6. The rolled product dispenser of claim 1, wherein the at least two longitudinally extending cutting blades move simultaneously between the cutting position and the non-cutting position.

7. The rolled product dispenser of claim 6, wherein the dispensing assembly comprises supporting members mounted to the housing and supporting the rotating drum and the guiding assembly comprises a guiding groove defined in each one of the supporting members and defining a closed loop, the distal end of each one of the at least two longitudinally extending cutting blades comprises a free rolling assembly inserted into a corresponding one of the guiding grooves and the simultaneous movements of the at least two longitudinally extending cutting blades between the cutting position and the non-cutting position result from the guiding grooves presenting a similar configuration and a similar orientation.

8. The rolled product dispenser of claim 1, wherein the at least two longitudinally extending cutting blades have a length which substantially corresponds to the drum length and the at least two longitudinally extending cutting blades translate substantially radially with respect to the rotating drum.

9. A rolled product dispenser for dispensing a web of rolled product having a web width, the rolled product dispenser comprising:

a housing;

a rotating drum at least partially housed in the housing and having a drum length delimited by two opposed drum ends; and at least two longitudinally extending cutting blades at least partially contained in the rotating drum, each one of the at least two longitudinally extending cutting blades being pivotally mounted inside the rotating drum to be configurable between a non-cutting configuration and a cutting configuration, each one of the at least two longitudinally extending cutting blades having a pivotal end mounted to the rotating drum, a distal end movable along a path inside the housing for configuring the at least two longitudinally extending cutting blades repeatedly in the non-cutting configuration and the cutting configuration, and a cutting edge provided between the pivotal and distal ends, wherein the pivotal end of a first one of the at least two longitudinally extending cutting blades is located adjacent to one of the two drum ends and opposed longitudinally to the pivotal end of a second one of the at least two longitudinally extending cutting blades located adjacent to the other one of the drum ends, wherein the cutting edges are configured to cooperate to perforate engage the web along the web width along a same cut-line.

10. The rolled product dispenser of claim 9, wherein the cutting edge of each one of the at least two longitudinally extending cutting blades extends along a section thereof located between the pivotal end and the distal end.

11. The rolled product dispenser of claim 10, wherein the section of the at least two longitudinally extending cutting blades including the cutting edge is located adjacent to the distal end thereof and the at least two longitudinally extending cutting blades have a length which substantially corresponds to the drum length and each one of the cutting edges comprises a serrated edge extending about half of the drum length.

12. The rolled product dispenser of claim 9, wherein the rotating drum comprises a housing and the pivotal end of the at least two longitudinally extending cutting blades is pivotally mounted to the housing.

13. The rolled product dispenser of claim 9, wherein the rotating drum comprises a housing and at least one fixation element extending inwardly of the housing and the pivotal ends of the at least two longitudinally extending cutting blades are pivotally mounted to the at least one fixation element.

14. The rolled product dispenser of claim 9, wherein the at least two longitudinally extending cutting blades move simultaneously between the cutting configuration and the non-cutting configuration and the at least two longitudinally extending cutting blades translate substantially radially with respect to the rotating drum.

15. The rolled product dispenser of claim 9, further comprising supporting members mounted to the housing and supporting the rotating drum, wherein at least one of the supporting members has a guiding closed loop groove defined therein and defining the path; and wherein the distal end of each one of the at least two longitudinally extending cutting blades comprises a free rolling assembly insertable into the guiding closed loop groove and defining a guiding assembly therewith.

16. A cutting assembly for a rolled product web having a web width, the cutting assembly comprising:

a rotating drum having a drum length; and at least two longitudinally extending cutting blades at least partially contained in the rotating drum, each one of the at least two longitudinally extending cutting blades having a pivotal end and a distal end with a cutting edge provided between the pivotal and distal ends and being pivotally mountable and configurable between a non-cutting configuration and a cutting configuration, the pivotal end of each one of the at least two longitudinally extending cutting blades being pivotally mounted to the rotating drum and independently of the other one of the at least two longitudinally extending cutting blades, the distal end of each one of the at least two longitudinally extending cutting blades being movable along a closed loop path for displacing the respective one of the at least two longitudinally extending cutting blades between the non-cutting configuration and the cutting configuration, wherein the pivotal end of a first one of the at least two longitudinally extending cutting blades is opposed longitudinally to the pivotal end of a second one of the at least two longitudinally extending cutting blades, and wherein the cutting edges are configured to cooperate to engage the web along the web width and along a same cut-line.

17. The cutting assembly of claim 16, wherein the cutting edge of each one of the at least two longitudinally extending cutting blades extends along a section thereof located between the pivotal end and the distal end and the section of the at least two longitudinally extending cutting blades including the cutting edge is located adjacent to the distal end thereof.

18. The cutting assembly of claim 16, wherein the at least two longitudinally extending cutting blades have a length which substantially corresponds to the drum length and each one of the cutting edges extend about half of the drum length.

19. The cutting assembly of claim 16, wherein the at least two longitudinally extending cutting blades are configured to move simultaneously between the cutting configuration and the non-cutting configuration.

20. A cutting assembly for a rolled product having a web width, the cutting assembly comprising:

a rotating drum having a drum length;

at least two longitudinally extending cutting blades at least partially contained in the rotating drum, each one of the at least two longitudinally extending cutting blades having a pivotal end and a distal end, opposed to the pivotal end, with a cutting edge provided between the pivotal and distal ends; and a guiding assembly, wherein the at least two longitudinally extending cutting blades overlap each other longitudinally along at least a section thereof, the pivotal end being pivotally mounted to the rotating drum, and the distal end being operationally engaged with the guiding assembly for configuring the at least two longitudinally extending cutting blades between a non-cutting configuration in which the at least two longitudinally extending cutting blades are spaced-apart from the rolled product and a cutting configuration in which the at least two longitudinally extending cutting blades are engaged with the rolled product and configured to cooperate to engage the web along the web width and along a same cut-line.

21. The cutting assembly of claim 20, wherein the cutting edge of each one of the at least two longitudinally extending cutting blades extends along a section thereof located between the pivotal end and the distal end and the section of the at least two longitudinally extending cutting blades including the cutting edge is located adjacent to the distal end thereof.

22. The cutting assembly of claim 20, wherein the at least two longitudinally extending cutting blades have a length which substantially corresponds to the drum length and each one of the cutting edges extend about half of the drum length.

23. The cutting assembly of claim 20, wherein the rotating drum comprises a housing and the pivotal end of the at least two longitudinally extending cutting blades is pivotally mounted to the housing.

24. The cutting assembly of claim 20, wherein the rotating drum comprises a housing and a fixation element extending inwardly of the housing and the pivotal end of the at least two longitudinally extending cutting blades is pivotally mounted to the fixation element.

25. The cutting assembly of claim 20, wherein the at least two longitudinally extending cutting blades are configured to move simultaneously between the cutting configuration and the non-cutting configuration and the at least two longitudinally extending cutting blades extend substantially tangential to a periphery of the rotating drum in the non-cutting configuration and substantially normal to the periphery of the rotating drum in the cutting configuration.

* * * * *